US010240772B2

(12) United States Patent
Chowdhury et al.

(10) Patent No.: US 10,240,772 B2
(45) Date of Patent: Mar. 26, 2019

(54) LIGHTWEIGHT HEAT SINKS AND LED LAMPS EMPLOYING SAME

(75) Inventors: Ashfaqul I. Chowdhury, Broadview Heights, OH (US); Gary R. Allen, Chesterland, OH (US); Thomas A. Knapp, Cleveland, OH (US)

(73) Assignee: GE Lighting Solutions, LLC, East Cleveland, OH (US)

( * ) Notice: Subject to any disclaimer, the term of this patent is extended or adjusted under 35 U.S.C. 154(b) by 612 days.

(21) Appl. No.: 12/979,476

(22) Filed: Dec. 28, 2010

(65) Prior Publication Data

US 2011/0242816 A1 Oct. 6, 2011

Related U.S. Application Data

(60) Provisional application No. 61/320,417, filed on Apr. 2, 2010.

(51) Int. Cl.
*F21K 9/64* (2016.01)
*F21K 9/232* (2016.01)
(Continued)

(52) U.S. Cl.
CPC ..... *F21V 29/71* (2015.01); *F21K 9/232* (2016.08); *F21K 9/64* (2016.08); *F21V 29/507* (2015.01);
(Continued)

(58) Field of Classification Search
CPC ..... F21V 29/71
(Continued)

(56) References Cited

U.S. PATENT DOCUMENTS 7,284,882 B2 * 10/2007 Burkholder ..... 362/294
7,303,315 B2 * 12/2007 Ouderkirk et al. ..... 362/294
(Continued)

FOREIGN PATENT DOCUMENTS

CN 1551339 A 12/2004
CN 2800701 Y 7/2006
(Continued)

OTHER PUBLICATIONS

PCT Search Report for PCT/US2011/028970.
(Continued)

*Primary Examiner* — Bryon T Gyllstrom
(74) *Attorney, Agent, or Firm* — Peter T. DiMauro; GPO Global Patent Operation

(57) ABSTRACT

A heat sink comprises a heat sink body, which in some embodiments is a plastic heat sink body, and a thermally conductive layer disposed over the heat sink body. In some embodiments the thermally conductive layer comprises a copper layer. A light emitting diode (LED)-based lamp comprises the aforementioned heat sink and an LED module including one or more LED devices in which the LED module is secured with and in thermal communication with the heat sink. Some such LED-based lamps may have an A-line bulb configuration or an MR or PAR configuration. Disclosed method embodiments comprise forming a heat sink body and disposing a thermally conductive layer on the heat sink body. The forming may comprise molding the heat sink body, which may be plastic. In some method embodiments the heat sink body includes fins and the disposing includes disposing the thermally conductive layer over the fins.

22 Claims, 12 Drawing Sheets

(51) Int. Cl.

| | |
|---|---|
| ***F21V 29/63*** | (2015.01) |
| ***F21V 29/67*** | (2015.01) |
| ***F21V 29/70*** | (2015.01) |
| ***F21V 29/71*** | (2015.01) |
| ***F21V 29/74*** | (2015.01) |
| ***F21V 29/77*** | (2015.01) |
| ***F21V 29/83*** | (2015.01) |
| ***F21V 29/89*** | (2015.01) |
| ***F21V 29/507*** | (2015.01) |
| ***F21Y 115/10*** | (2016.01) |

(52) U.S. Cl.
CPC ..... *F21V 29/63* (2015.01); *F21V 29/74* (2015.01); *F21V 29/773* (2015.01); *F21V 29/677* (2015.01); *F21V 29/70* (2015.01); *F21V 29/83* (2015.01); *F21V 29/89* (2015.01); *F21Y 2115/10* (2016.08); *Y10T 29/4935* (2015.01)

(58) Field of Classification Search
USPC ..... 362/580, 547, 218, 294, 373, 555, 545, 362/650, 249.02, 249.06, 800
See application file for complete search history.

(56) References Cited

U.S. PATENT DOCUMENTS

| | | | | |
|---|---|---|---|---|
| 7,547,124 | B2 * | 6/2009 | Chang et al. | 362/373 |
| 7,549,772 | B2 * | 6/2009 | Wang | 362/294 |
| 7,572,033 | B2 * | 8/2009 | Sun et al. | 362/294 |
| 7,679,096 | B1 | 3/2010 | Ruffin | |
| 7,842,960 | B2 | 11/2010 | Reginelli et al. | |
| 2004/0177947 | A1 * | 9/2004 | Krassowski et al. | 165/104.33 |
| 2009/0174302 | A1 * | 7/2009 | Davey et al. | 313/11 |
| 2009/0267474 | A1 * | 10/2009 | Zhou et al. | 313/12 |
| 2009/0273925 | A1 * | 11/2009 | Schultz et al. | 362/249.01 |
| 2009/0279314 | A1 * | 11/2009 | Wu et al. | 362/373 |
| 2009/0303735 | A1 * | 12/2009 | Chen | 362/373 |
| 2011/0080096 | A1 | 4/2011 | Dudik et al. | |
| 2011/0169394 | A1 | 7/2011 | Chowdhury et al. | |
| 2011/0242817 | A1 | 10/2011 | Chowdhury et al. | |
| 2012/0080699 | A1 | 4/2012 | Chowdhury et al. | |

FOREIGN PATENT DOCUMENTS

| | | | |
|---|---|---|---|
| EP | 1 469 513 | 10/2004 | |
| WO | WO 2009/084372 | 7/2009 | |
| WO | WO 2009115512 A1 * | 9/2009 | C08K 3/04 |

OTHER PUBLICATIONS

Substantive Examination and Search Report issued in connection with corresponding MY Application No. PI2012004406 dated Jul. 14, 2017.

Chowdhury, A. I., et al., Transparent Heat Fins—Transparent Thermally Conductive Polymer Composites for Light Source Thermal Management, GE Co-Pending U.S. Appl. No. 61/294,231, filed Jan. 12, 2010.

Chowdhury, A. I., et al., Lightweight heat sinks and led lamps employing same, GE Co-Pending U.S. Appl. No. 61/320,431, filed Apr. 2, 2010.

Chowdhury, A. I., et al., Multifunctional Heat-Fins for LED Lamp Optical and Thermal Management, GE Co-Pending U.S. Appl. No. 61/388,104, filed Sep. 30, 2010.

Chinese Office Action issued in connection with corresponding CN Application No. 201180027205.3 dated Sep. 3, 2014.

Chinese Office Action issued in connection with corresponding CN Application No. 201180027205.3 dated May 22, 2015.

Chinese Office Action issued in connection with related CN Application No. 2011800272053 dated Dec. 18, 2015.

Chinese Office Action issued in connection with corresponding CN Application No. 201180027205.3 dated Jul. 5, 2016.

Chinese Decision Rejection issued in connection with related CN Application No. 201180027205.3 dated Jan. 22, 2017.

* cited by examiner

Light Weight Low Cost Heat Sink with Effective Conductivity 100-200+ W/m-K

| | | |
|---|---|---|
| LED Par 38 Heat Sink Area | 932.2 | cm2 |
| LED Par 38 Heat Sink Volume | 104.05 | cm3 |
| Copper Thickness | 300 | microns |
| | 0.03 | cm |
| Copper Density | 8.9 | gm/cm3 |
| Aluminum Density | 2.6 | gm/cm3 |
| Polypropylene Density | 0.92 | gm/cm3 |
| Copper Cost | 7.50 | $/kg |
| Aluminum Cost | 2.54 | $/kg |
| Polypropylene Cost | 1.20 | $/kg |

| Heat Sink Material Choice | Heat Sink Weight, gm | Heat Sink Material Cost, $ |
|---|---|---|
| Aluminum | 271 | 0.69 |
| Cu clad PP | 124 | 0.32 |
| **Reduction, %** | **54%** | **53%** |

Fig. 15

LIGHTWEIGHT HEAT SINKS AND LED LAMPS EMPLOYING SAME

This application claims the benefit of U.S. Provisional Application No. 61/320,417 filed Apr. 2, 2010. U.S. Provisional Application No. 61/320,417 filed Apr. 2, 2010 is incorporated herein by reference in its entirety.

BACKGROUND

The following relates to the illumination arts, lighting arts, solid state lighting arts, thermal management arts, and related arts.

Incandescent, halogen, and high intensity discharge (HID) light sources have relatively high operating temperatures, and as a consequence heat egress is dominated by radiative and convective heat transfer pathways. For example, radiative heat egress goes with temperature raised to the fourth power, so that the radiative heat transfer pathway becomes superlinearly more dominant as operating temperature increases. Accordingly, thermal management for incandescent, halogen, and HID light sources typically amounts to providing adequate air space proximate to the lamp for efficient radiative and convective heat transfer. Typically, in these types of light sources, it is not necessary to increase or modify the surface area of the lamp to enhance the radiative or convective heat transfer in order to achieve the desired operating temperature of the lamp.

Light-emitting diode (LED)-based lamps, on the other hand, typically operate at substantially lower temperatures for device performance and reliability reasons. For example, the junction temperature for a typical LED device should be below 200° C., and in some LED devices should be below 100° C. or even lower. At these low operating temperatures, the radiative heat transfer pathway to the ambient is weak, so that convective and conductive heat transfer to ambient typically dominate. In LED light sources, the convective and radiative heat transfer from the outside surface area of the lamp or luminaire can be enhanced by the addition of a heat sink.

A heat sink is a component providing a large surface for radiating and convecting heat away from the LED devices. In a typical design, the heat sink is a relatively massive metal element having a large engineered surface area, for example by having fins or other heat dissipating structures on its outer surface. The large cross-sectional area and high thermal conductivity of the heat sink efficiently conducts heat from the LED devices to the heat fins, and the large surface area of the heat fins provides efficient heat egress by radiation and convection. For high power LED-based lamps it is also known to employ active cooling using fans or synthetic jets or heat pipes or thermo-electric coolers or pumped coolant fluid to enhance the heat removal.

BRIEF SUMMARY

In some embodiments disclosed herein as illustrative examples, a heat sink comprises a heat sink body and a thermally conductive layer disposed over the heat sink body. In some such embodiments the heat sink body is a plastic heat sink body. In some such embodiments the thermally conductive layer comprises a copper layer.

In some embodiments disclosed herein as illustrative examples, a light emitting diode (LED)-based lamp comprises: a heat sink as set forth in the immediately preceding paragraph; and an LED module including one or more LED devices, the LED module secured with and in thermal communication with the heat sink. In some such embodiments the LED-based lamp has an A-line bulb configuration. In some such embodiments the LED-based lamp as an MR or PAR configuration.

In some embodiments disclosed herein as illustrative examples, a method comprises: forming a heat sink body; and disposing a thermally conductive layer on the heat sink body. In some such embodiments the forming comprises molding the heat sink body. In some such embodiments the forming comprises molding the heat sink body as a molded plastic heat sink body. In some such embodiments the heat sink body includes fins and the disposing includes disposing the thermally conductive layer over the fins.

BRIEF DESCRIPTION OF THE DRAWINGS

FIG. 15 shows calculations for weight and material cost of a PAR-38 heat sink fabricated as disclosed herein using copper plating of a plastic heat sink body, as compared with a bulk aluminum heat sink of equal size and shape.

DETAILED DESCRIPTION OF PREFERRED EMBODIMENTS

In the case of incandescent, halogen, and HID light sources, all of which are thermal emitters of light, the heat transfer to the air space proximate to the lamp is managed by design of the radiative and convective thermal paths in order to achieve an elevated target temperature during operation of the light source. In contrast, in the case of LED light sources, photons are not thermally-excited, but rather are generated by recombination of electrons with holes at the p-n junction of a semiconductor. Both the performance and the life of the light source are optimized by minimizing the operating temperature of the p-n junction of the LED, rather than operating at an elevated target temperature. By providing a heat sink with fins or other surface area-increasing structures, the surface for convective and radiative heat transfer is enhanced.

Figure 1:
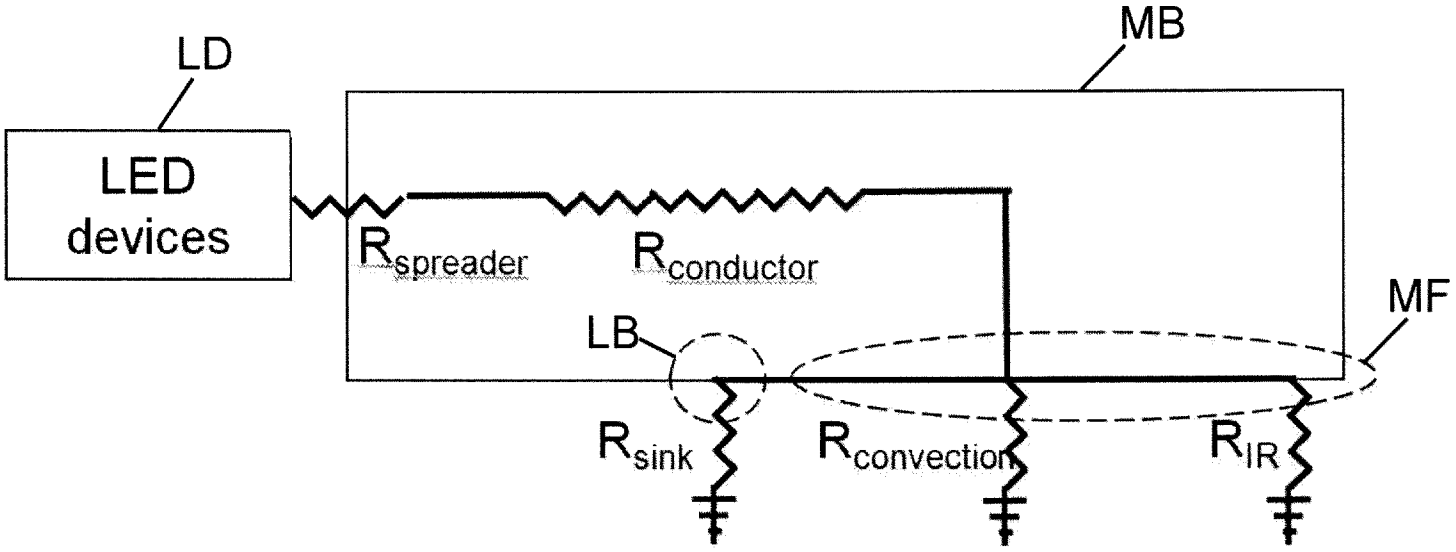
FIGS. 1 and 2 diagrammatically show thermal models for a conventional heat sink employing a metal heat sink component (FIG. 1) and for a heat sink as disclosed herein (FIG. 2).

With reference to FIG. 1, a metal heat sink MB with fins is diagrammatically indicated by a block, and the fins MF of the heat sink are diagrammatically indicated by a dashed oval. The surface through which heat is transferred into the surrounding ambient by convection and/or radiation is referred to herein as the heat sinking surface (e.g., the fins MF), and should be of large area to provide sufficient heat sinking for LED devices LD in steady state operation. Convective and radiative heat sinking into the ambient from the heat sinking surface MF can be modeled by thermal resistances $R_{convection}$ and $R_{IR}$, respectively or, equivalently, by thermal conductances. The resistance $R_{convection}$ models convection from the outside surface of the heat sink to the proximate ambient by natural or forced air flow. The resistance $R_{IR}$ models infrared (IR) radiation from the outside surface of the heat sink to the remote ambient. Additionally, a thermal conduction path (denoted in FIG. 1 by the resistances $R_{spreader}$ and $R_{conductor}$) is in series between the LED devices LD and the heat sinking surface MF, which represents thermal conduction from the LED devices LD to the heat sinking surface MF. A high thermal conductance for this series thermal conduction path ensures that heat egress from the LED devices to the proximate air via the heat sinking surface is not limited by the series thermal conductance. This is typically achieved by constructing the heat sink MB as a relatively massive block of metal having a finned or otherwise enhanced surface area MF defining the heat sinking surface—the metal heat sink body provides the desired high thermal conductance between the LED devices and the heat sinking surface. In this design, the heat sinking surface is inherently in continuous and intimate thermal contact with the metal heat sink body that provides the high thermal conductance path.

Thus, conventional heat sinking for LED-based lamps includes the heat sink MB comprising a block of metal (or metallic alloy) having the large-area heat sinking surface MF exposed to the proximate air space. The metal heat sink body provides a high thermal conductance pathway $R_{conductor}$ between the LED devices and the heat sinking surface. The resistance $R_{conductor}$ in FIG. 1 models conduction through the metal heat sink body MB. The LED devices are mounted on a metal-core circuit board or other support including a heat spreader, and heat from the LED devices conducts through the heat spreader to the heat sink. This is modeled by the resistance $R_{spreader}$.

In addition to heat sinking into the ambient via the heat sinking surface (resistances 12, $R_{convection}$ and $R_{IR}$), there is typically also some thermal egress (i.e., heat sinking) through the Edison base or other lamp connector or lamp base LB (diagrammatically indicated in the model of FIG. 1 by a dashed circle). This thermal egress through the lamp base LB is represented in the diagrammatic model of FIG. 1 by the resistance $R_{sink}$, which represents conduction through a solid or a heat pipe to the remote ambient or to the building infrastructure. However, it is recognized herein that in the common case of an Edison-type base, the thermal conductance and temperature limits of the base LB will limit the heat flux through the base to about 1 watt. In contrast, for LED-based lamps intended to provide illumination for interior spaces such as rooms, or for outdoor lighting, the heat output to be sinked is typically about 10 watts or higher. Thus, it is recognized herein that the lamp base LB cannot provide the primary heat sinking pathway. Rather, heat egress from the LED devices LD is predominantly via conduction through the metal heat sink body to the outer heat sinking surface of the heat sink where the heat is sinked into the surrounding ambient by convection ($R_{convection}$) and (to a lesser extent) radiation ($R_{IR}$). The heat sinking surface may be finned (e.g., fins MF in diagrammatic FIG. 1) or otherwise modified to enhance its surface area and hence increase the heat sinking.

Such heat sinks have some disadvantages. For example, the heat sinks are heavy due to the large volume of metal or metal alloy comprising the heat sink MB. A heavy metal heat sink can put mechanical stress on the base and socket which can result in failure and, in some failure modes, an electrical hazard. Another issue with such heat sinks is manufacturing cost. Fabricating a bulk metal heat sink component can be expensive, and depending on the choice of metal the material cost can also be high. Moreover, the heat sink is sometimes also used as a housing for electronics, or as a mounting point for the Edison base, or as a support for the LED devices circuit board. These applications call for the heat sink to be fabricated with some precision, which again increases manufacturing cost.

The inventors have analyzed these problems using the simplified thermal model shown in FIG. 1. The thermal model of FIG. 1 can be expressed algebraically as a series-parallel circuit of thermal impedances. In the steady state, all transient impedances, such as the thermal mass of the lamp itself, or the thermal masses of objects in the proximate ambient, such as lamp connectors, wiring, and structural mounts, may be treated as thermal capacitances. The transient impedances (i.e., thermal capacitances) may be ignored in steady state, just as electrical capacitances are ignored in DC electrical circuits, and only the resistances need be considered. The total thermal resistance $R_{thermal}$ between the LED devices and the ambient may be written as $$R_{thermal} = R_{spreader} + R_{conduction} + \left(\frac{1}{R_{sink}} + \frac{1}{R_{convection}} + \frac{1}{R_{IR}}\right)^{-1}$$

where: $R_{sink}$ is the thermal resistance of heat passing through the Edison connector (or other lamp connector) to the "ambient" electrical wiring; $R_{convection}$ is the thermal resistance of heat passing from the heat sinking surface into the surrounding ambient by convective heat transfer; $R_{IR}$ is the thermal resistance of heat passing from the heat sinking surface into the surrounding ambient by radiative heat transfer; and $R_{spreader}+R_{conduction}$ is the series thermal resistance of heat passing from the LED devices through the heat spreader ($R_{spreader}$) and through the metal heat sink body ($R_{conduction}$) to reach the heat sinking surface. It should be noted that for the term $1/R_{sink}$, the corresponding series thermal resistance is not precisely $R_{spreader}+R_{conductive}$ since the series thermal pathway is to the lamp connector rather than to the heat sinking surface—however, since the thermal conductance $1/R_{sink}$ through the base connector is small for a typical lamp this error is negligible. Indeed, a simplified model neglecting heat sinking through the base entirely can be written as $$R_{thermal} = R_{spreader} + R_{conduction} + \left(\frac{1}{R_{convection}} + \frac{1}{R_{IR}}\right)^{-1}.$$

This simplified equation demonstrates that the series thermal resistance $R_{conduction}$ through the heat sink body is a controlling parameter of the thermal model. Indeed, this is a justification for the conventional heat sink design employing the bulk metal heat sink MB—the heat sink body provides a very low value for the series thermal resistance $R_{conduction}$. In view of the foregoing, it is recognized that it would be desirable to achieve a heat sink that has a low series thermal resistance $R_{conduction}$, while simultaneously having reduced weight (and, preferably, reduced cost) as compared with a conventional heat sink.

One way this might be accomplished is to enhance thermal heat sinking $R_{sink}$ through the base, so that this pathway can be enhanced to provide a heat sinking rate of 10 watts or higher. However, in retrofit light source applications in which an LED lamp is used to replace a conventional incandescent or halogen or fluorescent or HID lamp, the LED replacement lamp is mounted into a conventional base or socket or luminaire of the type originally designed for an incandescent, halogen, or HID lamp. For such a connection, the thermal resistance $R_{sink}$ to the building infrastructure or to the remote ambient (e.g. earth ground) is large compared with $R_{convection}$ or $R_{IR}$ so that the thermal path to ambient by convection and radiation dominates.

Additionally, due to the relatively low steady state operating temperature of the LED assembly, the radiation path is typically dominated by the convection path (that is, $R_{conduction} << R_{IR}$). Therefore, the dominant thermal path for a typical LED-based lamp is the series thermal circuit comprising $R_{conduction}+R_{convection}$. It is therefore desired to provide a low series thermal resistance $RR_{conduction}+R_{convection}$, while reducing the weight (and, preferably, cost) of the heat sink.

The present inventors have carefully considered from a first-principles viewpoint the problem of heat removal in an LED-based lamp. It is recognized herein that, of the parameters typically considered of significance (heat sink volume, heat sink mass to conductivity ratio, heat sink surface area, and conductive heat removal and sinking through the base), the two dominant design attributes are the thermal conductance of the pathway between the LEDs and the heat sink (that is, $R_{conduction}$), and the outside surface area of the heat sink for convective and radiative heat transfer to the ambient (which affects $R_{convection}$ and $R_{IR}$).

Further analysis can proceed by a process of elimination. The heat sink volume is of importance only insofar as it affects heat sink mass and heat sink surface area. The heat sink mass is of importance in transient situations, but does not strongly affect steady-state heat removal performance, which is what is of interest in a continuously operating lamp, except to the extent that the metal heat sink body provides a low series resistance $R_{conduction}$. The heat sinking path through the base of a replacement lamp, such as a PAR or MR or reflector or A-line lamp, can be of significance for lower power lamps—however, the thermal conductance of an Edison base is only sufficient to provide about 1 watt of heat sinking to the ambient (and other base types such as pin-type bases are likely to have comparable or even less thermal conductance), and hence conductive heat sinking through the base to ambient is not expected to be of principle importance for commercially viable LED-based lamps which are expected to generate heating loads up to several orders of magnitude higher at steady state.

Figure 2:
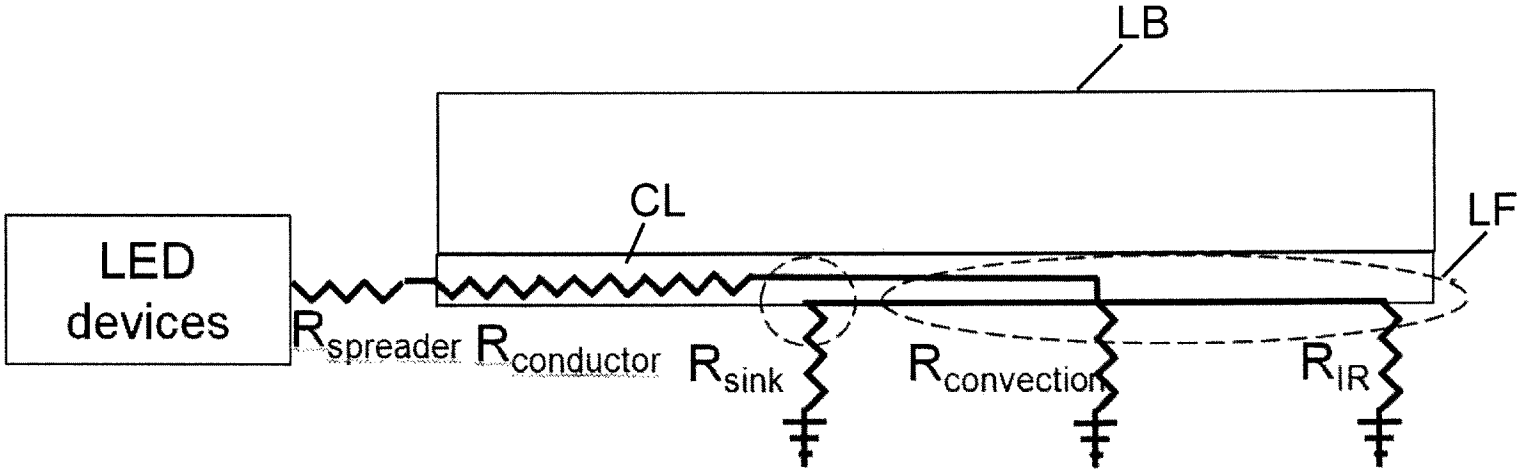

With reference to FIG. 2, based on the foregoing an improved heat sink is disclosed herein, comprising a lightweight heat sink body LB, which is not necessarily thermally conductive, and a thermally conductive layer CL disposed over the heat sink body to define the heat sinking surface. The heat sink body is not part of the thermal circuit (or, optionally, may be a minor component via some thermal conductivity of the heat sink body)—however, the heat sink body LB defines the shape of the thermally conductive layer CL that defines the heat sinking surface. For example, the heat sink body LB may have fins LF that are coated by the thermally conductive layer CL. Because the heat sink body LB is not part of the thermal circuit (as shown in FIG. 2), it can be designed for manufacturability and properties such as structural soundness and low weight. In some embodiments the heat sinking body LB is a molded plastic component comprising a plastic that is thermally insulating or has relatively low thermal conductivity.

The thermally conductive layer CL disposed over the lightweight heat sink body LB performs the functionality of the heat sinking surface, and its performance with respect to heat sinking into the surrounding ambient (quantified by the thermal resistances $R_{convection}$ and $R_{IR}$) is substantially the same as in the conventional heat sink modeled in FIG. 1. Additionally, however, the thermally conductive layer CL defines the thermal pathway from the LED devices to the heat sinking surface (quantified by the series resistance $R_{conduction}$). This also is diagrammatically shown in FIG. 2. To achieve a sufficiently low value for R conduction the thermally conductive layer CL should have a sufficiently large thickness (since $R_{conduction}$ decreases with increasing thickness) and should have a sufficiently low material thermal conductivity (since $R_{conduction}$ also decreases with increasing material thermal conductivity). It is disclosed herein that by suitable selection of the material and thickness of the thermally conductive layer CL, a heat sink comprising a lightweight (and possibly thermally insulating) heat sink body LB and a thermally conductive layer CL disposed over the heat sink body and defining the heat sinking surface can have heat sinking performance equal to or better than an equivalently sized and shaped heat sink of bulk metal, while simultaneously being substantially lighter, and cheaper to manufacture, than the equivalent heat sink of bulk metal. Again, it is not merely the surface area available for radiative/convective heat sinking to ambient that is determinative of the performance of the heat sink, but also the thermal conductance of heat across the outer surface defined by the heat sinking layer (that is, corresponding to the series resistance $R_{conduction}$) that is in thermal communication with the ambient. Higher surface conductance promotes more efficient distribution of the heat over the total heat sinking surface area and hence promotes the radiative and convective heat sinking to ambient.

In view of the foregoing, heat sink embodiments are disclosed herein which comprise a heat sink body and a thermally conductive layer disposed on the heat sink body at least over (and defining) the heat sinking surface of the heat sink. The material of the heat sink body has a lower thermal conductivity than the material of the thermally conductive layer. Indeed, the heat sink body can even be thermally insulating. On the other hand, the thermally conductive layer should have (i) an area and (ii) a thickness and (iii) be made of a material of sufficient thermal conductivity so that it provides radiative/convective heat sinking to the ambient that is sufficient to keep the p-n semiconductor junctions of the LED devices of the LED-based lamp at or below a specified maximum temperature, which is typically below 200° C. and sometimes below 100° C.

The thickness and material thermal conductivity of the thermally conductive layer together define a thermal sheet conductivity of the thermally conductive layer, which is analogous to an electrical sheet conductivity (or, in the inverse, an electrical sheet resistance). A thermal sheet resistance $$R_s = \frac{\rho}{d} = (\sigma \cdot d)^{-1}$$

may be defined, where ρ is the thermal resistivity of the material and σ is the thermal conductivity of the material, and d is the thickness of the thermally conductive layer. It is seen that the thermal sheet resistance suitably has units of K/W. Inverting yields the thermal sheet conductance $K_s=\sigma \cdot d$, having suitable units of W/K. Thus, a trade-off can be made between the thickness d and the material thermal conductivity σ of the thermally conductive layer. For high thermal conductivity materials, the thermally conductive layer can be made thin, which results in reduced weight, volume, and cost.

In embodiments disclosed herein, the thermally conductive layer comprises a metallic layer, such as copper, aluminum, various alloys thereof, or so forth, that is deposited by electroplating, vacuum evaporation, sputtering, physical vapor deposition (PVD), plasma-enhanced chemical vapor deposition (PECVD), or another suitable layer-forming technique operable at a sufficiently low temperature to be thermally compatible with plastic or other material of the heat sink body. In some illustrative embodiments, the thermally conductive layer is a copper layer that is formed by a sequence including electroless plating followed by electroplating.

The heat sink body (that is, the heat sink not including the thermally conductive layer) does not strongly impact the heat removal, except insofar as it defines the shape of the thermally conductive layer that performs the heat spreading (quantified by the series resistance $R_{conduction}$ in the thermal model of FIG. 2) and defines the heat sinking surface (quantified by the resistances $R_{convection}$ and $R_{IR}$ in the thermal model of FIG. 2). The surface area provided by the heat sink body affects the subsequent heat removal via radiation and convection. As a result, the heat sink body can be chosen to achieve desired characteristics such as low weight, low cost, structural rigidity or robustness, thermal robustness (e.g., the heat sink body should withstand the operating temperatures without melting or unduly softening), ease of manufacturing, maximal surface area (which in turn controls the surface area of the thermally conductive layer), and so forth. In some illustrative embodiments disclosed herein the heat sink body is a molded plastic element, for example made of a polymeric material such as poly (methyl methacrylate), nylon, polyethylene, epoxy resin, polyisoprene, sbs rubber, polydicyclopentadiene, polytetrafluoroethulene, poly(phenylene sulfide), poly(phenylene oxide), silicone, polyketone, thermoplastics, or so forth. The heat sink body can be molded to have fins or other heat radiation/convection/surface area enhancing structures.

To minimize cost, the heat sink body is preferably formed using a one-shot molding process and hence has a uniform material consistency and is uniform throughout (as opposed, for example, to a heat sink body formed by multiple molding operations employing different molding materials such that the heat sink body has a nonuniform material consistency and is not uniform throughout), and preferably comprises a low-cost material. Toward the latter objective, the material of the heat sink body preferably does not include any metal filler material, and more preferably does not include any electrically conductive filler material, and even more preferably does not include any filler material at all. However, it is also contemplated to include a metal filler or other filler, such as dispersed metallic particles to provide some thermal conductivity enhancement or nonmetallic filler particles to provide enhanced mechanical properties.

In the following, some illustrative embodiments are described.

Figure 4:
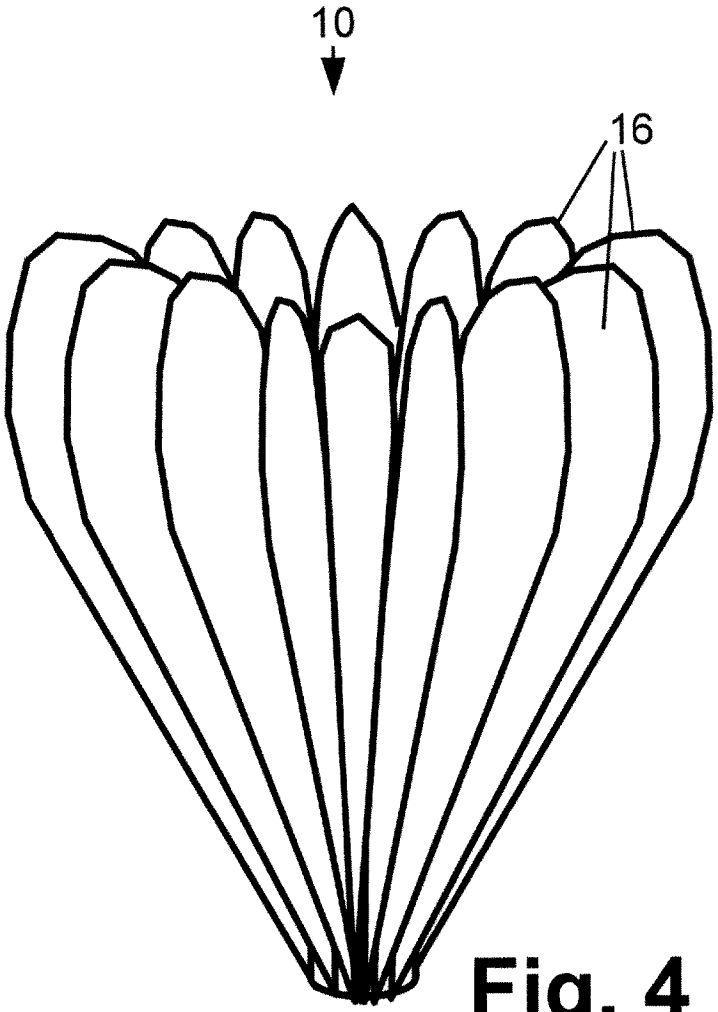
FIGS. 3 and 4 diagrammatically show side sectional and side perspective views, respectively, of a heat sink suitably used in an MR or PAR lamp.
Figure 3:
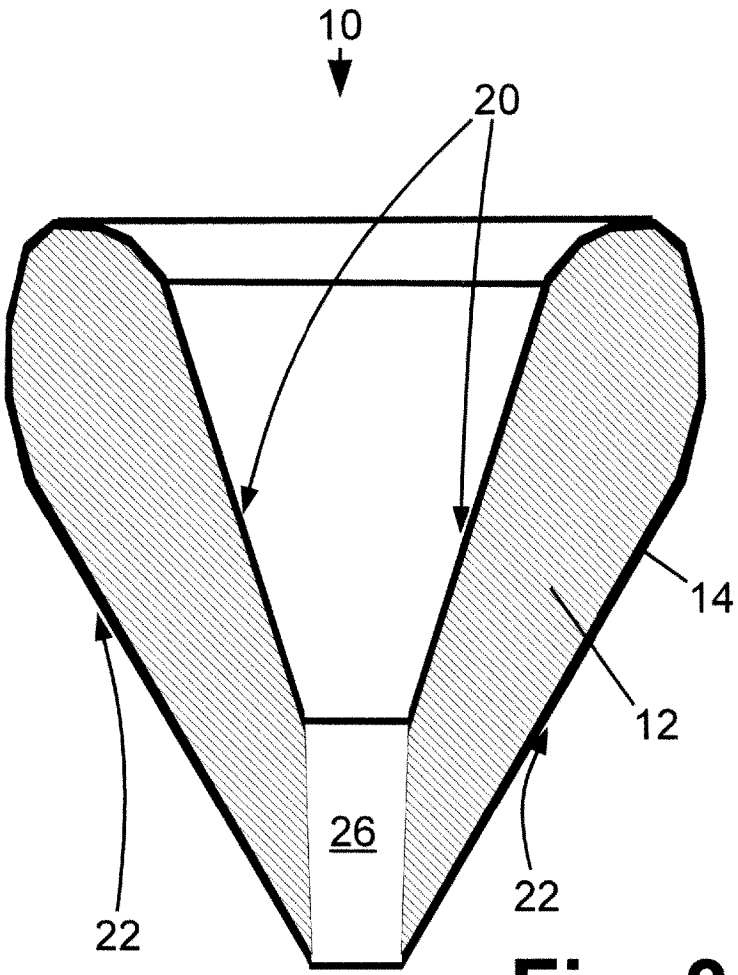

With reference to FIGS. 3 and 4, a heat sink 10 has a configuration suitable for use in an MR or PAR type LED-based lamp. The heat sink 10 includes a heat sink body 12 made of plastic or another suitable material as already described, and a thermally conductive layer 14 disposed on the heat sink body 12. The thermally conductive layer 14 may be a metallic layer such as a copper layer, an aluminum layer, or various alloys thereof. In illustrative embodiments, the thermally conductive layer 14 comprises a copper layer formed by electroless plating followed by electroplating.

As best seen in FIG. 4, the heat sink 10 has fins 16 to enhance the ultimate radiative and convective heat removal. Instead of the illustrated fins 16, other surface area enhancing structures could be used, such as multi-segmented fins, rods, micro/nano scale surface and volume features or so forth. The illustrative heat sink body 12 defines the heat sink 10 as a hollow generally conical heat sink having inner surfaces 20 and outer surfaces 22. In the embodiment shown in FIG. 3, the thermally conductive layer 14 is disposed on both the inner surfaces 20 and the outer surfaces 22. Alternatively, the thermally conductive layer may be disposed on only the outer surfaces 22, as shown in the alternative embodiment heat sink 10' of FIG. 7.

Figure 6:
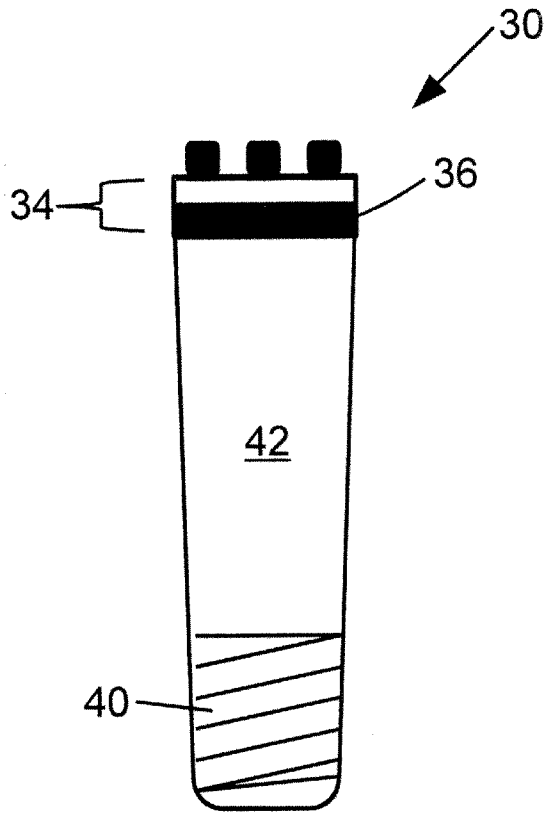
FIG. 6 diagrammatically shows a side view of the optical/electronic module of the MR or PAR lamp of FIG. 5.
Figure 5:
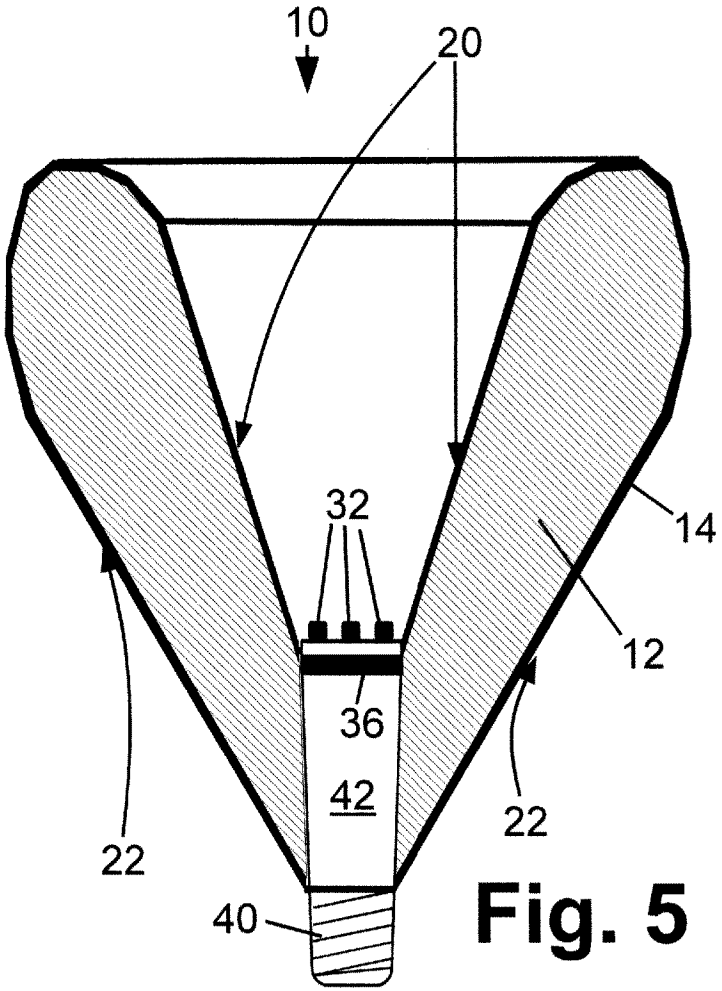
FIG. 5 diagrammatically shows a side sectional view of an MR or PAR lamp including the heat sink of FIGS. 3 and 4.

With continuing reference to FIGS. 3 and 4 and with further reference to FIGS. 5 and 6, the illustrative hollow generally conical heat sink 10 includes a hollow vertex 26. An LED module 30 (shown in FIG. 6) is suitably disposed at the vertex 26, as shown in FIG. 5) so as to define an MR- or PAR-based lamp. The LED module 30 includes one or more (and in the illustrative example three) light-emitting diode (LED) devices 32 mounted on a metal core printed circuit board (MCPCB) 34 that includes a heat spreader 36, for example comprising a metal layer of the MCPCB 34. The illustrative LED module 30 further includes a threaded Edison base 40; however, other types of bases, such as a bayonet pin-type base, or a pig tail electrical connector, can be substituted for the illustrative Edison base 40. The illustrative LED module 30 further includes electronics 42. The electronics may comprise an enclosed electronics unit 42 as shown, or may be electronic components disposed in the hollow vertex 26 of the heat sink 10 without a separate housing. The electronics 42 suitably comprise power supply circuitry for converting the A.C. electrical power (e.g., 110 volts U.S. residential, 220 volts U.S. industrial or European, or so forth) to (typically lower) DC voltage suitable for operating the LED devices 32. The electronics 42 may optionally include other components, such as electrostatic discharge (ESD) protection circuitry, a fuse or other safety circuitry, dimming circuitry, or so forth.

As used herein, the term "LED device" is to be understood to encompass bare semiconductor chips of inorganic or organic LEDs, encapsulated semiconductor chips of inorganic or organic LEDs, LED chip "packages" in which the LED chip is mounted on one or more intermediate elements such as a sub-mount, a lead-frame, a surface mount support, or so forth, semiconductor chips of inorganic or organic LEDs that include a wavelength-converting phosphor coating with or without an encapsulant (for example, an ultraviolet or violet or blue LED chip coated with a yellow, white, amber, green, orange, red, or other phosphor designed to cooperatively produce white light), multi-chip inorganic or organic LED devices (for example, a white LED device including three LED chips emitting red, green, and blue, and possibly other colors of light, respectively, so as to collectively generate white light), or so forth. The one or more LED devices 32 may be configured to collectively emit a white light beam, a yellowish light beam, red light beam, or a light beam of substantially any other color of interest for a given lighting application. It is also contemplated for the one or more LED devices 32 to include LED devices emitting light of different colors, and for the electronics 42 to include suitable circuitry for independently operating LED devices of different colors to provide an adjustable color output.

The heat spreader 36 provides thermal communication from the LED devices 32 to the thermally conductive layer 14. Good thermal coupling between the heat spreader 36 and the thermally conductive layer 14 may be achieved in various ways, such as by soldering, thermally conductive adhesive, a tight mechanical fit optionally aided by high thermal conductivity pad between the LED module 30 and the vertex 26 of the heat sink 10, or so forth. Although not illustrated, it is contemplated to have the thermally conductive layer 14 be also disposed over the inner diameter surface of the vertex 26 to provide or enhance the thermal coupling between the heat spreader 36 and the thermally conductive layer 14.

Figure 7:
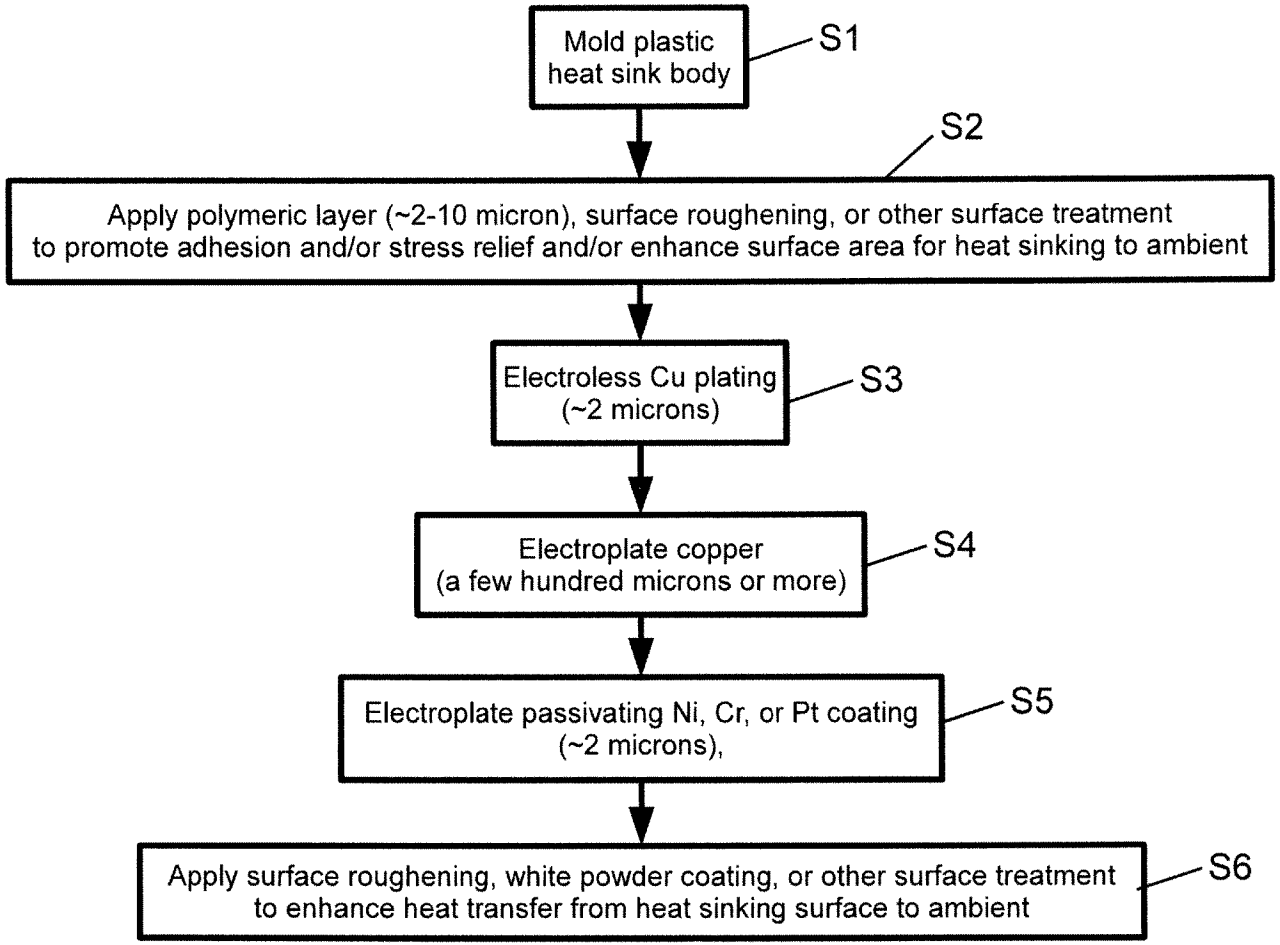
FIG. 7 diagrammatically flow charts a suitable manufacturing process for manufacturing a lightweight heat sink.

With reference to FIG. 7, a suitable manufacturing approach is set forth. In this approach the heat sink body 12 is first formed in an operation S1 by a suitable method such as by molding, which is convenient for forming the heat sink body 12 in embodiments in which the heat sink body 12 comprises a plastic or other polymeric material. Other approaches for forming the heat sink body 12 include casting, extruding (in the case of a cylindrical heat sink, for example), or so forth. In an optional operation S2, the surface of the molded heat sink body is processed by applying a polymeric layer (typically around 2-10 micron), performing surface roughening, or by applying other surface treatment. The optional surface processing operation(s) S2 can perform various functions such as promoting adhesion of the subsequently plated copper, providing stress relief, and/or enhancing surface area for heat sinking to ambient. On the latter point, by roughening or pitting the surface of the plastic heat sink body, the subsequently applied copper coating will follow the roughening or pitting so as to provide a larger heat sinking surface.

In an operation S3 an initial layer of copper is applied by electroless plating. The electroless plating advantageously can be performed on an electrically insulating (e.g., plastic) heat sink body. However, electroless plating has a slow deposition rate. Design considerations set forth herein, especially providing a sufficiently low series thermal resistance $R_{conduction}$, motivate toward employing a plated copper layer whose thickness is of order a few hundred microns. Accordingly, the electroless plating is used to deposit an initial copper layer (preferably having a thickness of no more than ten microns, and in some embodiments having a thickness of about 2 microns or less) so that the plastic heat sink body with this initial copper layer is electrically conductive. The initial electroless plating S3 is then followed by an electroplating operation S4 which rapidly deposits the balance of the copper layer thickness, e.g. typically a few hundred microns. The electroplating S4 has a much higher deposition rate as compared with electroless plating S3.

One issue with a copper coating is that it can tarnish, which can have adverse impact on the heat sinking thermal transfer from the surface into the ambient, and also can be aesthetically displeasing. Accordingly, in an optional operation S5 a suitable passivating layer is optionally deposited on the copper, for example by electroplating a passivating metal such as nickel, chromium, or platinum on the copper. The passivating layer, if provided, typically has a thickness of no more than ten microns, and in some embodiments has a thickness of about two microns or less. An optional operation(s) S6 can also be performed, to provide various surface enhancements such as surface roughening, or surface protection, or to provide a desired aesthetic appearance, such as applying a thin coating of paint, lacquer, or polymer or a powder coating such as a metal oxide powder (e.g., titanium dioxide powder, aluminum oxide powder, or a mixture thereof, or so forth), or so forth. These surface treatments are intended to enhance heat transfer from the heat sinking surface to the ambient via enhanced convection and/or radiation.

Figure 8:
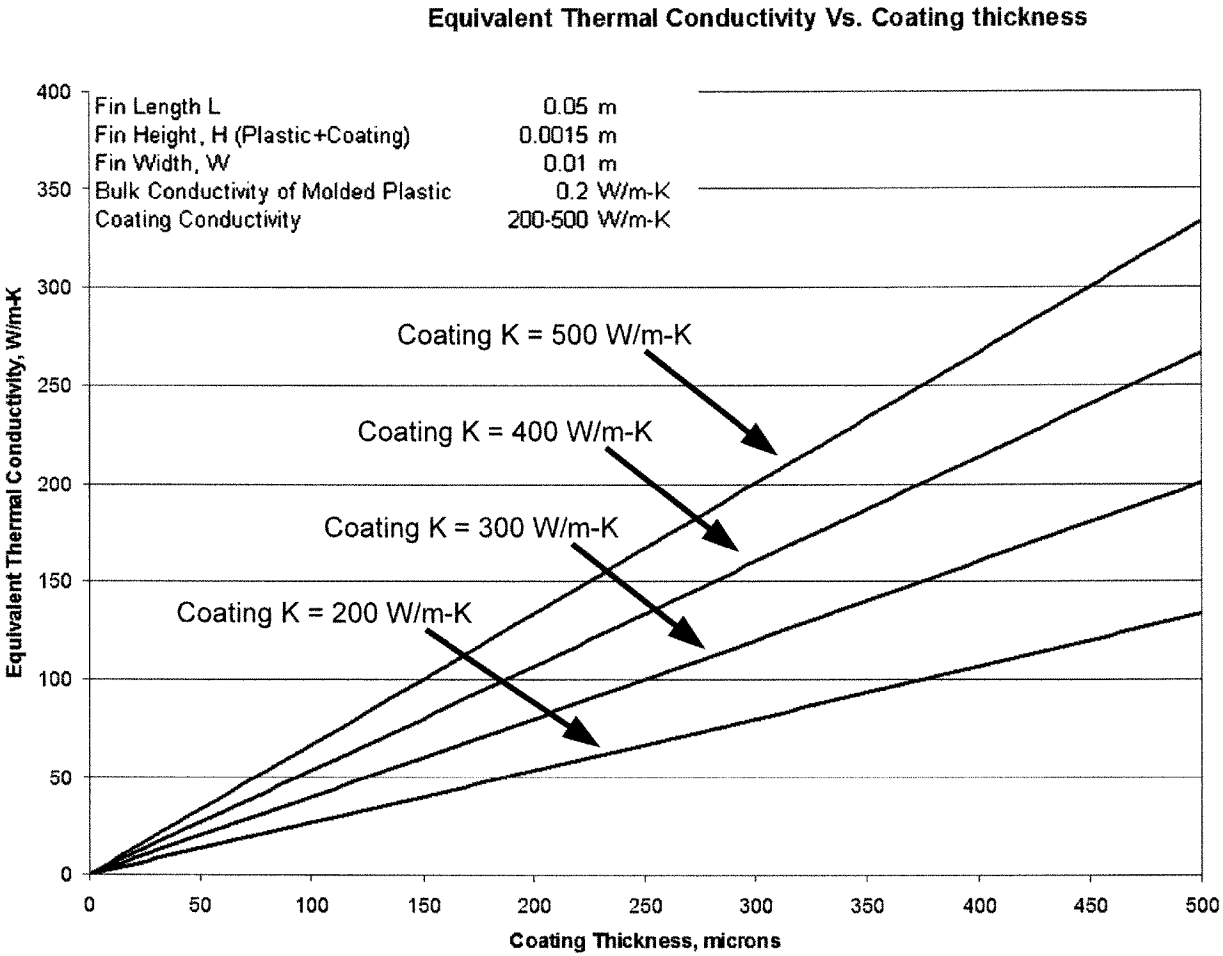
FIG. 8 plots coating thickness versus equivalent K data for a simplified "slab" type heat sink portion (e.g., a planar "fin").

With reference to FIG. 8, simulation data are shown for optimizing the thickness of the thermally conductive layer for a material thermal conductivity in a range of 200-500 W/mK, which are typical material thermal conductivities for various types of copper. (It is to be appreciated that, as used herein, the term "copper" is intended to encompass various copper alloys or other variants of copper). The heat sink body in this simulation has a material thermal conductivity of 2 W/mK, but it is found that the results are only weakly dependent on this value. The values of FIG. 8 are for a simplified "slab" heat sink having length 0.05 m, thickness 0.0015 m, and width 0.01 meters, with the thermally conductive material coating both sides of the slab. This may, for example, corresponding to a heat sink portion such as a planar fin defined by the plastic heat sink body and plated with copper of thickness 200-500 W/mK. It is seen in FIG. 8 that for 200 W/mK material a copper thickness of about 350 microns provides an equivalent (bulk) thermal conductivity of 100 W/mK. In contrast, more thermally conductive 500 W/mK material, a thickness of less than 150 microns is sufficient to provide an equivalent (bulk) thermal conductivity of 100 W/mK. Thus, a plated copper layer having a thickness of a few hundred microns is sufficient to provide steady state performance related to heat conduction and subsequent heat removal to the ambient via radiation and convection that is comparable with the performance of a bulk metal heat sink made of a metal having thermal conductivity of 100 W/mK.

In general, the sheet thermal conductance of the thermally conductive layer 14 should be high enough to ensure the heat from the LED devices 32 is spread uniformly across the heat radiating/convecting surface area. In simulations performed by the inventors, it has been found that the performance improvement with increasing thickness of the thermally conductive layer 14 (for a given material thermal conductivity) flattens out once the thickness exceeds a certain level (or, more precisely, the performance versus thickness curve decays approximately exponentially). Without being limited to any particular theory of operation, it is believed that this is due to the heat sinking to the ambient becoming limited at higher thicknesses by the radiative/convective thermal resistance and $R_{convection}$ and $R_{IR}$ rather than by the thermal resistance $R_{conduction}$ of the heat transfer through the thermally conductive layer. Said another way, the series thermal resistance $R_{conduction}$, becomes negligible compared with $R_{convection}$ and $R_{IR}$ at higher layer thicknesses.

Figure 9:
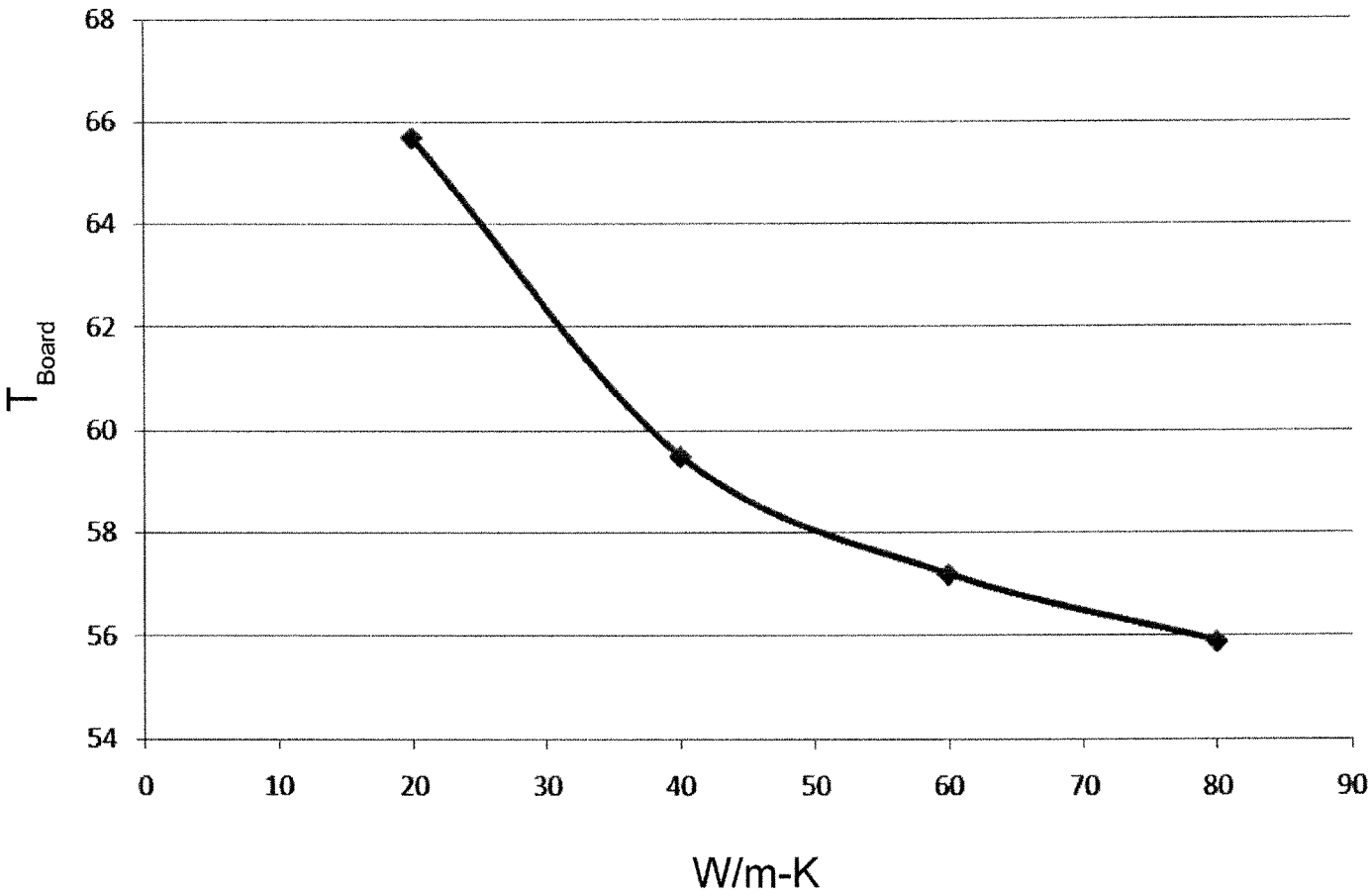
FIGS. 9 and 10 show thermal performance as a function of material thermal conductivity for a bulk metal heat sink.
Figure 10:
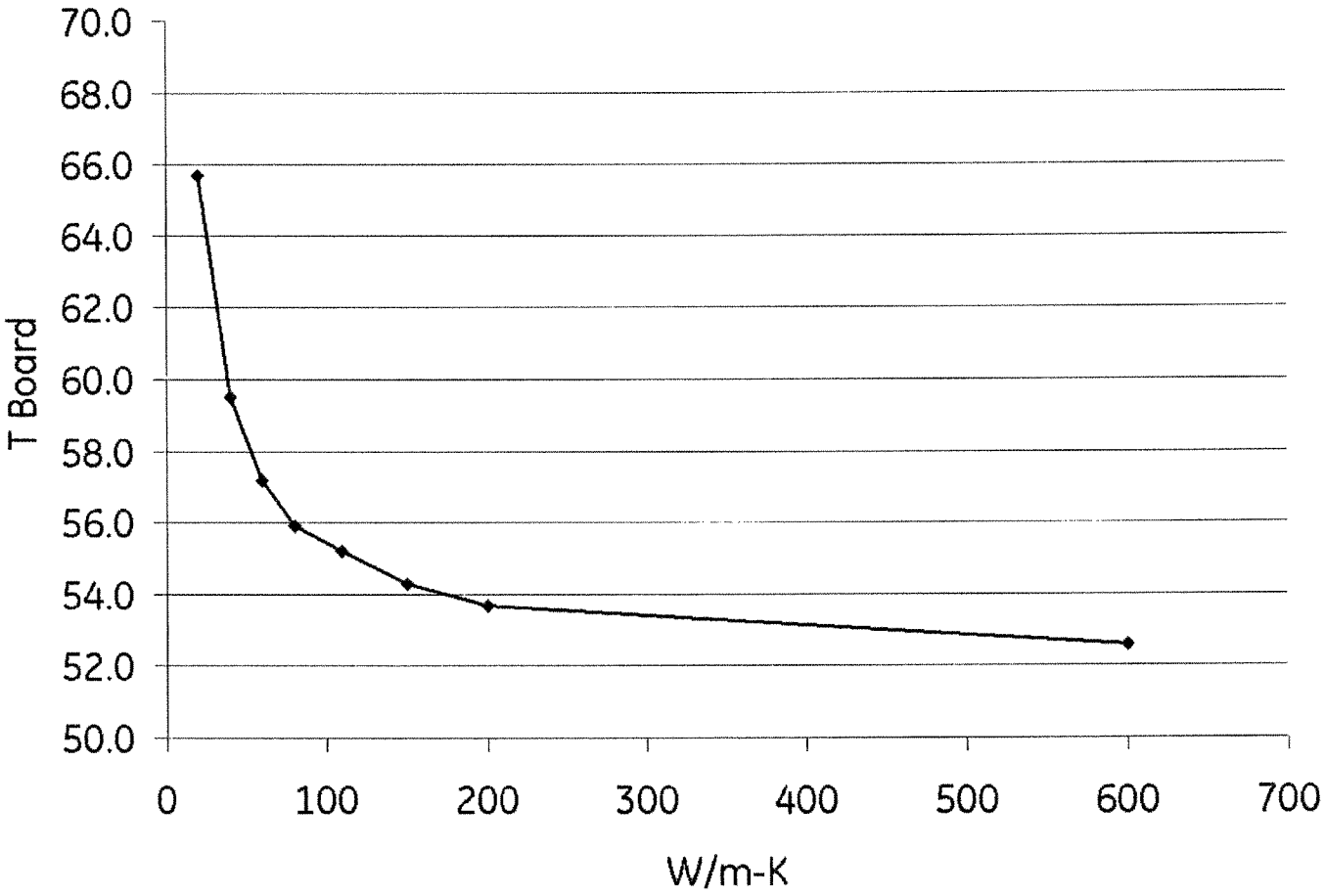

With reference to FIGS. 9 and 10, similar performance flattening with increasing material thermal conductivity is seen in thermal simulations of a bulk metal heat sink. FIG. 9 shows results obtained by simulated thermal imaging of a bulk heat sink for four different material thermal conductivities: 20 W/m·K; 40 W/m·K; 60 W/m·K; and 80 W/m·K.

The LED board temperature ($T_{board}$) for each simulation is plotted in FIG. 9. It is seen that the $T_{board}$ drop begins to level off at 80 W/m·K. FIG. 10 plots $T_{board}$ versus material thermal conductivity of the bulk heat sink material for thermal conductivities out to 600 W/m·K, which shows substantial performance flattening by the 100-200 W/m·K range. Without being limited to any particular theory of operation, it is believed that this is due to the heat sinking to the ambient becoming limited at higher (bulk) material conductivities by the radiative/convectivethermal resistance $R_{convection}$ and $R_{IR}$ rather than by the thermal resistance $R_{conduction}$ of the heat transfer through the thermally conductive layer. Said another way, the series thermal resistance $R_{conduction}$ becomes negligible compared with $R_{convection}$ and $R_{IR}$ at high (bulk) material thermal conductivity.

Based on the foregoing, in some contemplated embodiments the thermally conductive layer 14 has a thickness of 500 micron or less and a thermal conductivity of 50 W/m·K or higher. For copper layers of higher material thermal conductivity, a substantially thinner layer can be used. For example, commonly-used aluminum alloys formed by common manufacturing processes typically have a (bulk) thermal conductivity of about 100 W/m·K, although pure aluminum may have conductivity as a high as about 240 W/m-K. From FIG. 8, it is seen that heat sinking performance exceeding that of a typical bulk aluminum heat sink is achievable for a 500 W/m·K copper layer having a thicknesses of about 150 microns or thicker. Heat sinking performance exceeding that of a bulk aluminum heat sink is achievable for a 400 W/m·K copper layer having a thicknesses of about 180 microns or thicker. Heat sinking performance exceeding that of a bulk aluminum heat sink is achievable for a 300 W/m·K copper layer having a thicknesses of about 250 microns or thicker. Heat sinking performance exceeding that of a bulk aluminum heat sink is achievable for a 200 W/m·K copper layer having a thicknesses of about 370 microns or thicker. In general, the material thermal conductivity and layer thickness scale in accordance with the thermal sheet conductance $K_s=\sigma \cdot d$. In some embodiments, the thermal sheet conductance $K_s$ is at least 0.05 W/K. For more efficient LED light engines that produce less heat, a lower thermal conductance, such as $K_s$ being at least 0.0025 W/K, is also contemplated.

Figure 12:
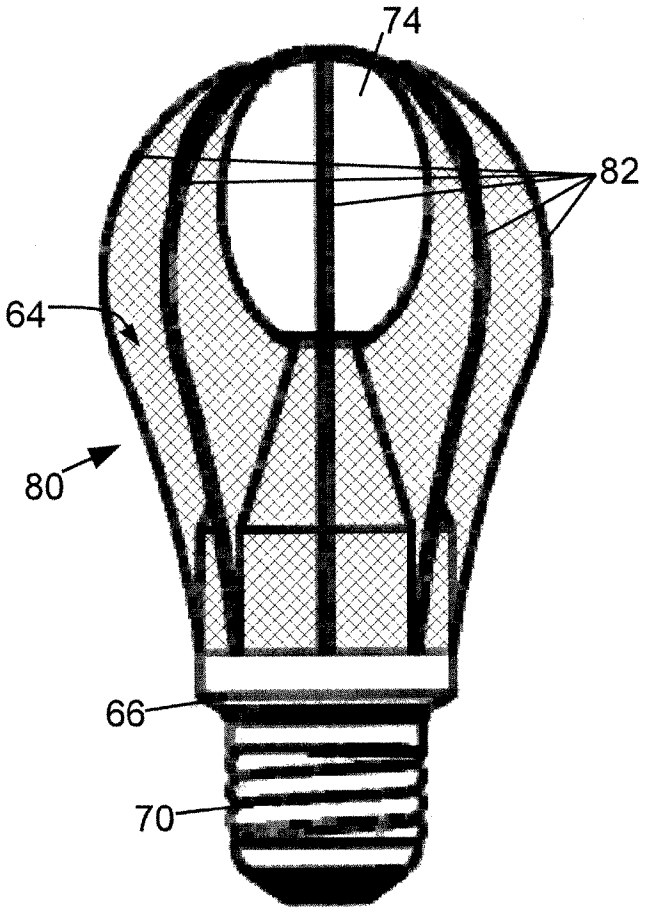
FIG. 12 diagrammatically shows a side perspective view of a variation of the "A-line bulb" lamp of FIG. 9, in which the heat sink includes fins.
Figure 11:
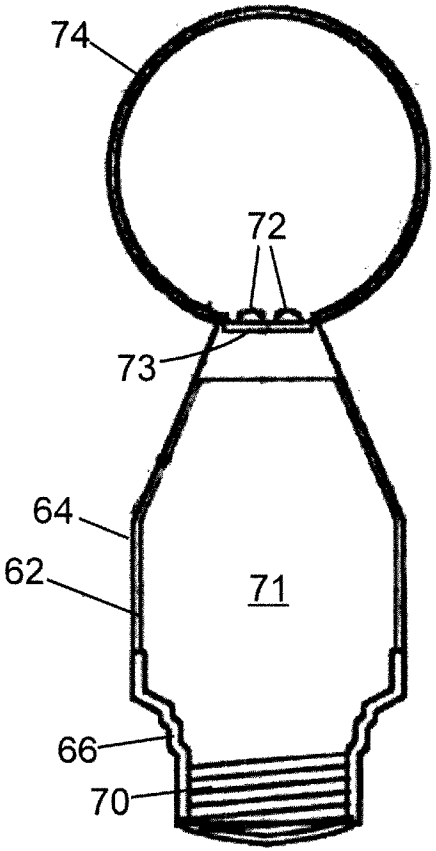
FIG. 11 diagrammatically shows a side sectional view of an "A-line bulb" lamp incorporating a heat sink as disclosed herein.

With reference to FIGS. 11 and 12, the disclosed heat sink aspects can be incorporated into various types of LED-based lamps.

FIG. 11 shows a side sectional view of an "A-line bulb" lamp of a type that is suitable for retrofitting incandescent A-line bulbs. A heat sink body 62 forms a structural foundation, and may be suitably fabricated as a molded plastic element, for example made of a polymeric material such as poly propylene, polycarbonate, polyimide, polyetherimide, poly (methyl methacrylate), nylon, polyethylene, epoxy resin, polyisoprene, sbs rubber, polydicyclopentadiene, polytetrafluoroethulene, poly(phenylene sulfide), poly(phenylene oxide), silicone, polyketone, thermoplastics, or so forth. A thermally conductive layer 64, for example comprising a copper layer, is disposed on the heat sink body 62. The thermally conductive layer 64 can be manufactured in the same way as the thermally conductive layer 14 of the MR/PAR lamp embodiments of FIGS. 3-5 and 7, e.g. in accordance with the operations S2, S3, S4, S5, S6 of FIG. 8.

A lamp base section 66 is secured with the heat sink body 62 to form the lamp body. The lamp base section 66 includes a threaded Edison base 70 similar to the Edison base 40 of the MR/PAR lamp embodiments of FIGS. 3-5 and 7. In some embodiments the heat sink body 62 and/or the lamp base section 66 define a hollow region 71 that contains electronics (not shown) that convert electrical power received at the Edison base 70 into operating power suitable for driving LED devices 72 that provide the lamp light output. The LED devices 72 are mounted on a metal core printed circuit board (MCPCB) or other heat-spreading support 73 that is in thermal communication with the thermally conductive layer 64. Good thermal coupling between the heat spreader 73 and the thermally conductive layer 64 may optionally be enhanced by soldering, thermally conductive adhesive, or so forth.

To provide a substantially omnidirectional light output over a large solid angle (e.g., at least $2\pi$ steradians) a diffuser 74 is disposed over the LED devices 72. In some embodiments the diffuser 74 may include (e.g., be coated with) a wavelength-converting phosphor. For LED devices 72 producing a substantially Lambertian light output, the illustrated arrangement in which the diffuser 74 is substantially spherical and the LED devices 72 are located at a periphery of the diffuser 74 enhances omnidirectonality of the output illumination.

With reference to FIG. 12, a variant "A-line bulb" lamp is shown, which includes the base section 66 with Edison base 70 and the diffuser 74 of the lamp of FIG. 11, and also includes the LED devices 72 (not visible in the side view of FIG. 12). The lamp of FIG. 12 includes a heat sink 80 analogous to the heat sink 62, 64 of the lamp of FIG. 11, and which has a heat sink body (not visible in the side view of FIG. 12) that is coated with the thermally conductive layer 64 (indicated by cross-hatching in the side perspective view of FIG. 12) disposed on the heat sink body. The lamp of FIG. 12 differs from the lamp of FIG. 11 in that the heat sink body of the heat sink 80 is shaped to define fins 82 that extend over portions of the diffuser 74. Instead of the illustrative fins 82, the heat sink body can be molded to have other heat radiation/convection/surface area enhancing structures.

In the embodiment of FIG. 12, it is contemplated for the heat sink body of the heat sink 80 and the diffuser 74 to comprise a single unitary molded plastic element. In this case, however, the single unitary molded plastic element should be made of an optically transparent or translucent material (so that the diffuser 74 is light-transmissive). Additionally, if the thermally conductive layer 64 is optically absorbing for the lamp light output (as is the case for copper, for example), then as shown in FIG. 12 the thermally conductive layer 64 should coat only the heat sink 80, and not the diffuser 74. This can be accomplished by suitable masking of the diffuser surface during the electroless copper plating operation S3, for example. (The electroplating operation S4 plates copper only on the conductive surfaces—accordingly, masking during the electroless copper plating operation S3 is sufficient to avoid electroplating onto the diffuser 74).

Figure 14:
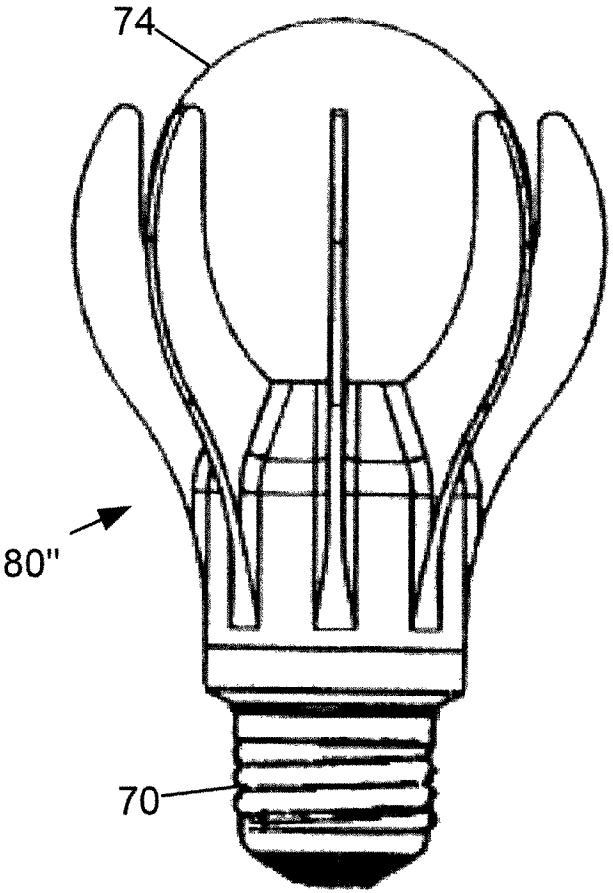
FIGS. 13 and 14 diagrammatically show side perspective views of additional embodiments of finned "A-line bulb" lamps.
Figure 13:
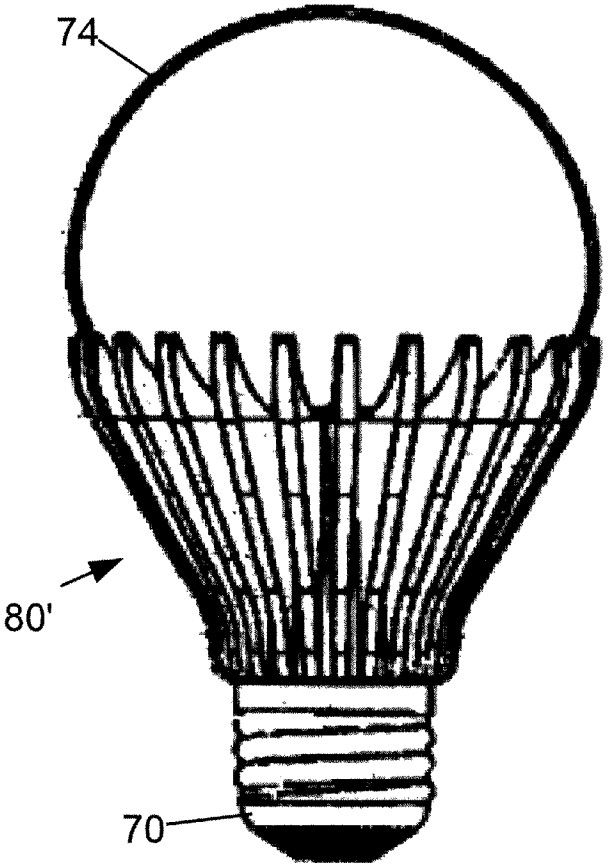

FIGS. 13 and 14 show alternative heat sinks 80', 80" that are substantially the same as the heat sink 80, except that the fins do not extend as far over the diffuser 74. In these embodiments the diffuser 74 and the heat sink body of the heat sink 80', 80" may be separately molded (or otherwise separately fabricated) elements, which may simplify the processing to dispose the thermally conductive layer 64 on the heat sink body.

FIG. 15 shows calculations for weight and material cost of an illustrative PAR-38 heat sink fabricated as disclosed herein using copper plating of a plastic heat sink body, as compared with a bulk aluminum heat sink of equal size and shape. This example assumes a polypropylene heat sink body plated with 300 microns of copper. Material costs shown in FIG. 15 are merely estimates. The weight and material cost are both reduced by about one-half as compared with the equivalent bulk aluminum heat sink. Additional cost reduction is expected to be realized through reduced manufacture processing costs.

Figure 17:
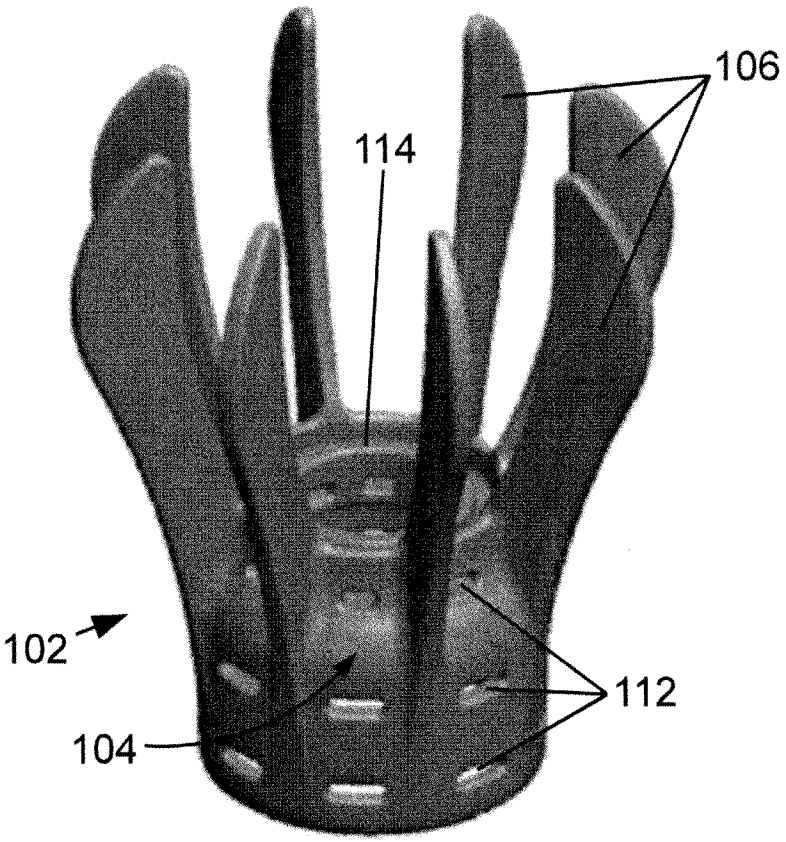
FIGS. 16 and 17 diagrammatically show side perspective views of a heat sink body (FIG. 16) and completed heat sink (FIG. 17) which includes thermal shunt paths.
Figure 16:
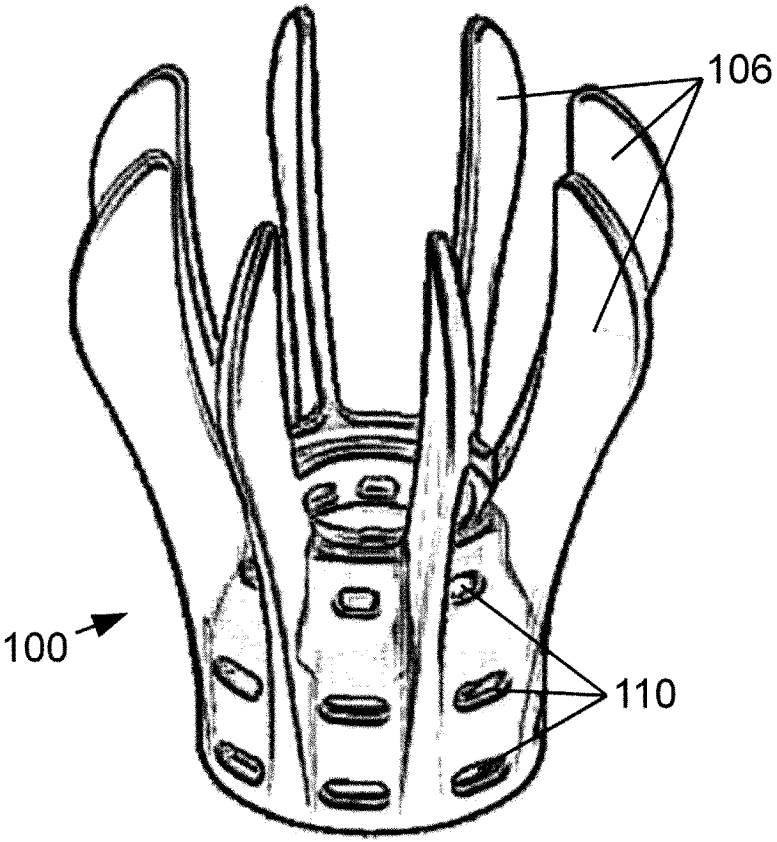

With reference to FIGS. 16 and 17, in some embodiments the heat sink includes thermal shunting paths through the bulk of the heat sink body to provide further enhanced thermal conductance. FIG. 16 illustrates a heat sink body 100 made of plastic, before coating with a thermally conductive layer, while FIG. 17 shows the heat sink 102 including a thermally conductive layer 104 (e.g., a copper layer). Although not shown in FIG. 17, it is contemplated for the completed heat sink to also include a surface enhancement such as surface roughening, a white powder coating such as a metal oxide powder, or so forth disposed on the thermally conductive layer 104 to enhance heat transfer, aesthetics, or to provide additional/other benefit.

The heat sink body 100 is suitably a molded plastic element, for example made of a polymeric material such as poly (methyl methacrylate), nylon, polyethylene, epoxy resin, polyisoprene, sbs rubber, polydicyclopentadiene, polytetrafluoroethulene, poly(phenylene sulfide), poly(phenylene oxide), silicone, polyketone, thermoplastics, or so forth. The heat sink body 100 is molded to have fins 106, and has a shape similar to the heat sink 80" shown in FIG. 14. However, the heat sink body 100 also includes passages 110 passing through the heat sink body 100. As seen in FIG. 17, the thermally conductive layer 104 coats the surfaces defining the passages 110 so as to form thermal shunting paths 112 through the heat sink body 100. Toward this end, the coating process that applies the thermally conductive layer 104 should be omnidirectional and should not, for example, exhibit shadowing as in the case of vacuum deposition. The electroplating process of FIG. 7, for example, provides suitably omnidirectional coating of copper onto the heat sink body 100 so as to coat inside the passages 110 to provide the thermal shunt paths 112.

With reference to FIG. 17, the benefit of the thermal shunt paths 112 can be understood as follows. A periphery of an LED light engine including a circular circuit board (not shown) rests on an annular ledge 114 of the heat sink 102. Heat conducts away from this ledge 114 both upward and downward. The portion of the heat conducting away from the ledge in the downward direction is moving along the inner surface of the heat sink 102, away from the fins 106 and generally "inside" of the heat sink 102. To reach the fins 106 the heat flows around to the outer surface of the heat sink 102, or flows through the (highly thermally resistive) heat sink body 100. Similarly long and/or thermally resistive heat flow paths are encountered by heat flowing from any electronics disposed inside the heat sink 102. The thermal shunt paths 112 bypass these long and/or thermally resistive heat flow paths by providing highly thermally conductive paths thermally connecting the inner and outer surfaces of the heat sink body 100.

The precise size, shape, and arrangement of the thermal shunt paths 112 is suitably selected based on the locations and characteristics of the heat sources (e.g., LED devices, electronics, or so forth). In the illustrative heat sink 102, a topmost annular row of thermal shunt paths 112 proximately surround the annular ledge 114 and thus provides thermal shunting for heat generated by the LED engine. The two lower annular rows of thermal shunt paths 112 proximately surround any electronics disposed inside the heat sink 102, and thus provide thermal shunting for heat generated by the electronics. Moreover, while the illustrative thermal shunt paths 112 are shown for the heat sink 102 which is suitably used in an omnidirectional lamp (see, e.g., FIG. 14), thermal shunt paths are also optionally included in other lightweight heat sinks, such as in the hollow generally conical heat sink 10 (see FIGS. 3-5). In terms of the thermal model of FIG. 2, the thermal shunt paths generally reduce the thermal resistance of the thermal conductance pathway $R_{conductor}$ between the LED devices and the heat sinking surface. However, the increased surface area provided by the thermal shunt paths may also provide enhanced convective/radiative heat transfer into the ambient.

Another benefit of providing thermal shunt paths is that the overall weight of the (already lightweight) heat sink may be further decreased. However, this benefit depends upon whether the mass of the heat sink body material "removed" to define the passages 110 is greater than the additional thermally conductive layer material that coats inside the passages 110 to form the thermal shunt paths 112.

In the embodiment of FIGS. 16 and 17, the passages 110 are sufficiently large that the thermally conductive layer 104 does not completely occlude or seal off the passages. However, it is also contemplated for the passages to be sufficiently small such that the subsequent electroplating or other process forming the thermally conductive layer 104 completely occludes or seals off the passages. The thermal shunting is not affected by such occlusion, except that the thermal conductance would cease to further increase with further increase in thickness of the thermally conductive layer beyond the thickness sufficient for occlusion.

On the other hand, if the passages 110 are sufficiently large that the thermally conductive layer 104 does not completely occlude or seal off the passages (as is the case in FIG. 17, for example), then the fluid conduction pathways provided by the thermal shunt paths 112 can optionally have additional advantages. As already noted, one benefit is increased surface area which can enhance thermal convection/radiation to the ambient. Another contemplated benefit is that the fluid pathways of the thermal shunt paths 112 can serve as orifices operating in conjunction with an actively driven vibrational membrane, rotating fan, or other device (not shown) to provide active cooling via synthetic jet action and/or a cooling air flow pattern.

The preferred embodiments have been illustrated and described. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A heat sink comprising:

a heat sink body and heat radiating fins, said fins including a first edge engaging said body and a remote second edge, side walls extending between said first edge and said second edge, said body and fins being comprised of a plastic; and a thermally conductive layer disposed over at least the side walls of said heat sink fins, said thermally conductive layer extending between said first edge and said second edge, wherein the thermally conductive layer has a thickness of 500 micron or less and a thermal conductivity of 50 W/m·K or higher.

2. The heat sink of claim 1, wherein the thermally conductive layer has a thickness of at least 100 micron.

3. The heat sink of claim 1, wherein the thermally conductive layer has a thermal sheet conductance of at least 0.025 W/K.

4. The heat sink of claim 1, wherein the thermally conductive layer has a thermal sheet conductance of at least 0.05 W/K.

5. The heat sink of claim 1, wherein the heat sink, body and fins do not include any metal or electrically conductive filler material.

6. The heat sink of claim 1, wherein the fins have a roughened surface and the thermally conductive layer disposed on the roughened surface conforms with the roughened surface.

7. The heat sink of claim 1, wherein the thermally conductive layer comprises copper.

8. A heat sink comprising:

a heat sink body and heat radiating fins, said fins including a first edge engaging said body and a remote second edge, side walls extending between said first edge and said second edge, said body and fins being comprised of a plastic; and a thermally conductive layer disposed over at least the side walls of said heat sink fins, said thermally conductive layer extending between said first edge and said second edge, wherein the thermally conductive layer has a thermal sheet conductance of at least 0.0025 W/K.

9. A heat sink comprising:

a heat sink body and heat radiating fins, said fins including a first edge engaging said body and a remote second edge, side walls extending between said first edge and said second edge, said body and fins being comprised of a plastic; and a thermally conductive layer disposed over at least the side walls of said heat sink fins, said thermally conductive layer extending between said first edge and said second edge, said heat sink further comprising a polymeric layer disposed between the fins and the thermally conductive layer and extending between the first edge and the second edge.

10. The heat sink of claim 9, wherein the polymeric layer has a thickness of between 2 microns and 10 microns inclusive.

11. The heat sink of claim 9, further comprising at least one of a powder coating, paint, lacquer, and polymer disposed on the thermally conductive layer.

12. A heat sink comprising:

a heat sink body and heat radiating fins, said fins including a first edge engaging said body and a remote second edge, side walls extending between said first edge and said second edge, said body and fins being comprised of a plastic; and a thermally conductive layer disposed over at least the side walls of said heat sink fins, said thermally conductive layer extending between said first edge and said second edge, the thermally conductive layer comprising:

a copper layer encompassing the heat sink body and fins; and a passivating metal layer disposed on the copper layer.

13. The heat sink of claim 12, wherein the passivating metal layer is selected from a group consisting of a nickel layer, a chromium layer, and a platinum layer.

14. The heat sink of claim 12, wherein the copper layer has a thickness of at least 150 micron and the passivating metal layer has a thickness of no more than ten microns.

15. A heat sink comprising:

a heat sink body and heat radiating fins, said fins including a first edge engaging said body and a remote second edge, side walls extending between said first edge and said second edge, said body and fins being comprised of a plastic; and a thermally conductive layer disposed over at least the side walls of said heat sink fins, said thermally conductive layer extending between said first edge and said second edge, wherein the fins are thermally insulating.

16. A heat sink comprising:

a heat sink body and heat radiating fins, said fins including a first edge engaging said body and a remote second edge, side walls extending between said first edge and said second edge, said body and fins being comprised of a plastic; and a thermally conductive layer disposed over at least the side walls of said heat sink fins, said thermally conductive layer extending between said first edge and said second edge, wherein the heat sink body includes passages that are coated by the thermally conductive layer disposed over the heat sink body to define thermal shunting paths.

17. A light emitting diode (LED)-based lamp comprising a heat sink having a heat sink body and heat radiating fins, said fins including a first edge engaging said body and a remote second edge, side walls extending between said first edge and said second edge, said body and fins being comprised of a plastic;

a thermally conductive layer disposed over at least the side walls of said heat sink fins, said thermally conductive layer extending between said first edge and said second edge and wherein the thermally conductive layer has a thickness of 500 micron or less and a thermal conductivity of 50 W/m·K or higher; and:

an LED module including one or more LED devices, the LED module secured with and in thermal communication with the heat sink such that the fins are in optical communication with said LED module.

18. The LED-based lamp of claim 17, wherein the thermally conductive layer of the heat sink comprises copper.

19. The LED-based lamp of claim 17, wherein the plastic heat sink body comprises a polymeric material selected from a group consisting of poly (methyl methacrylate), nylon, polyethylene, epoxy resin, polyisoprene, sbs rubber, polydicyclopentadiene, polytetrafluoroethulene, poly(phenylene sulfide), poly(phenylene oxide), silicone, polyketone, and a thermoplastic.

20. The LED-based lamp of claim 17, wherein the LED-based lamp has an A-line bulb configuration.

21. The LED-based lamp of claim 17, wherein the LED-based lamp has an MR or PAR configuration.

22. The LED-based lamp of claim 17, wherein the heat sink body includes passages that are coated by the thermally conductive layer disposed over the heat sink body to define thermal shunting paths thermally connecting the LED module with a heat radiating surface of the heat sink.

* * * * *